US008683775B1

(12) United States Patent
Jones

(10) Patent No.: US 8,683,775 B1
(45) Date of Patent: Apr. 1, 2014

(54) SPACER SYSTEM FOR INSTALLING VACUUM INSULATED GLASS (VIG) WINDOW UNIT IN WINDOW FRAME DESIGNED TO ACCOMMODATE THICKER IG WINDOW UNIT

(75) Inventor: Jeffrey A. Jones, Ann Arbor, MI (US)

(73) Assignee: Guardian Industries Corp., Auburn Hills, MI (US)

( * ) Notice: Subject to any disclaimer, the term of this patent is extended or adjusted under 35 U.S.C. 154(b) by 0 days.

(21) Appl. No.: 13/606,212

(22) Filed: Sep. 7, 2012

(51) Int. Cl.
*E04C 2/54* (2006.01)

(52) U.S. Cl.
USPC ..... 52/786.13; 52/204.67; 52/204.7; 52/788.1

(58) Field of Classification Search
USPC ..... 52/204.67, 204.7, 204.705, 204.71, 52/786.1, 786.13, 788.1; 49/501, 504, 505
See application file for complete search history.

(56) References Cited

U.S. PATENT DOCUMENTS

| | | | | |
|---|---|---|---|---|
| 621,542 | A * | 3/1899 | Sheppard | 52/209 |
| 3,389,522 | A * | 6/1968 | Hordis | 52/204.599 |
| 3,442,059 | A * | 5/1969 | Kessler | 52/204.595 |
| 3,992,843 | A * | 11/1976 | DiFazio | 52/204.593 |
| 4,015,394 | A * | 4/1977 | Kessler | 52/786.1 |
| 4,055,031 | A * | 10/1977 | Okawa et al. | 52/172 |
| 4,478,003 | A * | 10/1984 | Flett | 49/63 |
| 4,615,159 | A * | 10/1986 | Kessler | 52/171.3 |
| 5,131,194 | A * | 7/1992 | Anderson | 52/144 |
| 5,628,155 | A * | 5/1997 | Nolte et al. | 52/204.54 |
| 5,657,607 | A | 8/1997 | Collins et al. | |
| 5,664,395 | A | 9/1997 | Collins et al. | |
| 5,683,764 | A * | 11/1997 | Alts | 428/34 |
| 5,902,652 | A | 5/1999 | Collins et al. | |
| 6,167,662 | B1 * | 1/2001 | Gruber | 52/204.1 |
| 6,383,580 | B1 | 5/2002 | Aggas | |
| 6,692,600 | B2 | 2/2004 | Veerasamy et al. | |
| 6,701,749 | B2 | 3/2004 | Wang et al. | |
| 6,782,718 | B2 | 8/2004 | Lingle et al. | |
| 6,827,977 | B2 | 12/2004 | Veerasamy | |
| 2003/0089054 | A1 * | 5/2003 | Hornung | 52/204.62 |
| 2005/0183351 | A1 * | 8/2005 | Brunnhofer | 52/204.5 |
| 2006/0185273 | A1 * | 8/2006 | Lathief | 52/204.71 |
| 2009/0324858 | A1 * | 12/2009 | Jaeger | 428/34 |
| 2012/0315409 | A1 * | 12/2012 | Jones | 428/34 |
| 2013/0101759 | A1 * | 4/2013 | Jones | 428/34 |

FOREIGN PATENT DOCUMENTS

| | | | |
|---|---|---|---|
| AT | 377 053 | 2/1985 | |
| DE | 27 04 808 | 8/1978 | |
| DE | 202009016113 U1 * | 5/2011 | E06B 3/58 |
| EP | 0 244 494 | 11/1987 | |
| EP | 0 566 070 | 10/1993 | |

OTHER PUBLICATIONS

International Search Report mailed Nov. 4, 2013.

* cited by examiner

*Primary Examiner* — Brian Glessner
*Assistant Examiner* — Adam Barlow
(74) *Attorney, Agent, or Firm* — Nixon & Vanderhye P.C.

(57) ABSTRACT

A vacuum insulated glass (VIG) window unit installation configuration and method for installing a VIG window unit in a window frame that was designed to accommodate at least a thicker IG (insulating glass/integrated glass) window unit(s). The VIG window unit may be supported on a first side by a first stop portion of the frame and on a second side by a second stop portion of the frame. A spacer structure is provided along at least one side of the VIG window unit between the VIG window unit and at least one of the first and second stop portions, the spacer structure including at least one hollow area surrounded by a solid portion when viewed cross sectionally.

27 Claims, 10 Drawing Sheets

Completed Assy with sides snapped in place
and VHB adhesive secured to VIG

W/ VIG Addded, sides folding
up with living hinge

SPACER SYSTEM FOR INSTALLING VACUUM INSULATED GLASS (VIG) WINDOW UNIT IN WINDOW FRAME DESIGNED TO ACCOMMODATE THICKER IG WINDOW UNIT

TECHNICAL FIELD

The disclosure relates generally to vacuum insulated glass (VIG) window unit installation configurations and methods for installing a VIG window unit in a window frame that was designed to accommodate at least a thicker IG (insulating glass/integrated glass) window unit(s). Certain embodiments relate to a peripheral spacer system for use in installing a VIG window unit in a window frame that was designed to accommodate at least a thicker IG window unit, the spacer system being provided around the periphery of the VIG unit adjacent the frame. Such techniques, including the spacer system, can be used for example in either new construction with new window frames, or to replace existing JO windows in old window frames that previously housed IG units.

BACKGROUND AND SUMMARY OF EXAMPLE EMBODIMENTS

Vacuum insulating glass (VIG) units typically include two spaced apart glass substrates with an evacuated or low-pressure gap/space/cavity therebetween. The substrates are interconnected by a peripheral edge seal and typically include an array of spacers/pillars between the glass substrates to maintain spacing between the glass substrates and to avoid collapse of the glass substrates that may be caused due to the low pressure environment that exists between the substrates. Some example VIG configurations are disclosed, for example, in U.S. Pat. Nos. 5,657,607, 5,664,395, 5,657,607, 5,902,652, 6,701,749, and 6,383,580, the disclosures of which are all hereby incorporated by reference herein in their entireties.

FIGS. 1 and 2 illustrate a typical VIG window unit 1 and elements that form the VIG window unit 1. For example, VIG unit 1 may include two spaced apart substantially parallel glass substrates 2, 3, which enclose an evacuated low-pressure space/cavity 6 therebetween. Glass sheets or substrates 2,3 are interconnected by a peripheral edge seal 4 which may be made of fused solder glass or the like, for example. An array of support pillars/spacers 5 may be included between the glass substrates 2, 3 to maintain the spacing of substrates 2, 3 of the VIG unit 1 in view of the low-pressure space/gap 6 present between the substrates 2, 3.

A pump-out tube 8 may be hermetically sealed by, for example, solder glass 9 or the like to an aperture/hole 10 that passes from an interior surface of one of the glass substrates 2 to the bottom of an optional recess 11 in the exterior surface of the glass substrate 2, or optionally to the exterior surface of the glass substrate 2. A vacuum is attached to and/or communicates with pump-out tube 8 to evacuate the interior cavity 6 to a low pressure that is less than atmospheric pressure, for example, using a sequential pump down operation. After evacuation of the cavity 6, a portion (e.g., the tip) of the tube 8 is melted to seal the vacuum in low pressure cavity/space 6. The optional recess 11 may retain the sealed pump-out tube 8. Optionally, a chemical getter 12 may be included within a recess 13 that is disposed in an interior face of one of the glass substrates, e.g., glass substrate 2. The chemical getter 12 may be used to absorb or bind with certain residual impurities that may remain after the cavity 6 is evacuated and sealed.

VIG units with fused solder glass peripheral edge seals 4 are typically manufactured by depositing glass frit or other suitable material, in a solution (e.g., frit paste), around the periphery of substrate 2 (or on substrate 3). This glass frit paste ultimately forms the edge seal 4. The other substrate (e.g., 3) is brought down on substrate 2 so as to sandwich spacers/pillars 5 and the glass frit solution between the two substrates 2, 3. The entire assembly including the glass substrates 2, 3, the spacers/pillars 5 and the seal material (e.g., glass frit in solution or paste), is then heated to a high temperature (e.g., of at least about 500° C.), at which point the glass frit melts, wets the surfaces of the glass substrates 2, 3, and ultimately forms a hermetic peripheral/edge seal 4.

After formation of the edge seal 4 between the substrates, a vacuum is drawn via the pump-out tube 8 to form low pressure space/cavity 6 between the substrates 2, 3. The pressure in space 6 may be produced by way of an evacuation process to a level below atmospheric pressure, e.g., below about $10^{-2}$ Torr. To maintain the low pressure in the space/cavity 6, substrates 2, 3 are hermetically sealed via the edge seal 4 and sealing off of the pump-out tube. Small high strength spacers/pillars 5 are provided between the transparent glass substrates to maintain separation of the approximately parallel glass substrates against atmospheric pressure. As noted above, once the space 6 between substrates 2, 3 is evacuated, the pump-out tube 8 may be sealed, for example, by melting its tip using a laser or the like.

Dual pane VIG window units are generally much more efficient insulators than typical dual pane non-vacuum IG window units. VIG window units, while having better performance, are also significantly thinner than non-vacuum IG window units. Because of the difference in thickness, a typical window installation structure, e.g., a window frame (e.g., sash), may need to be redesigned to effectively utilize and accept a VIG window unit if it was originally designed for a thicker JO unit. This may result in replacement of the window frame (e.g., which may include a sash) in order to accommodate a thinner VIG unit. Redesigning window structures and replacing and/or redesigning window frames (e.g., sashes) is costly and time consuming and may contribute to slow adoption of VIG window units, especially in existing buildings or by smaller manufacturers, in spite of the many benefits and advantages associated with VIG window units.

It will be appreciated that standard IG window units are rather thick, and come in various thicknesses (e.g., from about 19-40 mm thick). As mentioned above, window frames are typically designed to accept these thick IG window units, e.g., for use in office building, home residences, apartment buildings, etc. On the other hand, VIG window units are significantly thinner (e.g., from about 4-12 mm thick, more preferably from about 4-10 mm thick, more preferably from about 7-9 mm thick, with an example thickness being about 8.3 mm) than typical IG window units. And thermal performance of VIG units is dramatically better than that of IG window units (e.g., VIG units have higher R-values than do IG units).

It would be desirable to use VIG units in window frames that were designed to accommodate IG units. This would allow one to avoid, or reduce, the need for redesigns of window frames and/or changes to window frames.

Certain example embodiments of this invention relate to a peripheral spacer system for use in installing a VIG window unit in a window frame (which may include a sash) that was designed to accommodate at least a thicker IG window unit, the spacer system being provided around the periphery of the VIG unit so as to be located adjacent the frame and/or located between the frame and the glass substrates of the VIG unit. The spacer system may fit around the glass substrates of the VIG unit, preferably on all four sides of the window in one or more pieces. Thus, with respect to the spacer system, structures and/or techniques are provided for installing thinner VIG window units in window frames that were/are designed for thicker IG window units, thereby possibly avoiding or reducing the need to redesign or significantly change window frames. Such techniques can be used in either new construction with new window frames, or to replace existing IG windows in old window frames that previously housed IG units, or repairing either IG or VIG window units by replacing an existing window with a VIG window. Thus, it will be appreciated that this disclosure is not limited to replacing IG windows with VIG windows in existing frames, e.g., it is also relates to structure(s) designed for new VIG window units.

Certain example embodiments of this invention are advantageous with respect to one or more of: (i) encouraging adoption of high-efficiency high-performance VIG window units including their improved thermal performance, (ii) reducing the amount of time for adoption of VIG window units by window manufacturers and/or enabling rapid adoption and/or deployment of VIG, (iii) providing the ability to implement VIG window units in window designs that were/are designed for thicker IG units with little or no modification of the frame (e.g., including sash) structure, (iv) providing the ability for low-volume window manufacturers to adopt VIG window units, (v) reducing tooling required for window manufacturers, (vi) maintaining the appearance of the window features and/or aesthetics, and/or (vii) providing a spacer system to be located around the VIG glass substrates so that it can fit into a frame designed for thicker 10 units, wherein the spacer system (a) provides improved thermal insulation, (b) helps protect the unit during shipping from manufacturing facilities to window factories and/or job sites, (c) provides added strength/integrity to the VIG unit; and/or (d) improves thermal performance of VIG units at edge(s) thereof.

In certain example embodiments of this invention, there is provided a window unit comprising: a VIG window unit in a window frame, the window frame capable of supporting a non-vacuum IG window unit having a larger width than does the VIG window unit, said VIG window unit comprising first and second glass substrates with a low pressure gap provided therebetween, the low pressure gap being at pressure less than atmospheric pressure; the VIG window unit being supported (directly or indirectly) on a first side by a first stop portion of said frame and being supported (directly or indirectly) on a second side by a second stop portion of said frame; and a spacer structure provided along at least one side of the VIG window unit between the VIG window unit and at least one of the first and second stop portions of the window frame, the spacer structure including at least one hollow area surrounded by a solid portion when viewed cross sectionally.

In certain embodiments of this invention, there is provided a method of installing a vacuum insulated glass (VIG) window unit, the method comprising: seating a VIG window unit, having a thickness of from about 4-12 mm, in a window frame, the window frame capable of supporting a non-vacuum IG window unit having a larger width than does the VIG window unit, said VIG window unit comprising first and second glass substrates with a low pressure gap provided therebetween, the low pressure gap being at a pressure less than atmospheric pressure, and after said seating the VIG window unit being supported (directly or indirectly) on a first side by a first stop portion of said frame and being supported (directly or indirectly) on a second side by a second stop portion of said frame, and wherein a gap between the first and second stop portions is from about 19-40 mm; and wherein a spacer structure is provided along at least one side of the VIG window unit between the VIG window unit and at least one of the first and second stop portions of the window frame, the spacer structure including at least one hollow area surrounded by a solid portion when viewed cross sectionally, wherein the hollow area is substantially filled with air, foam, and/or insulating material.

These and other embodiments and advantages are described herein with respect to certain example embodiments and with reference to the following drawings in which like reference numerals refer to like elements, and wherein:

DETAILED DESCRIPTION OF EXAMPLE EMBODIMENTS

Figure 2:
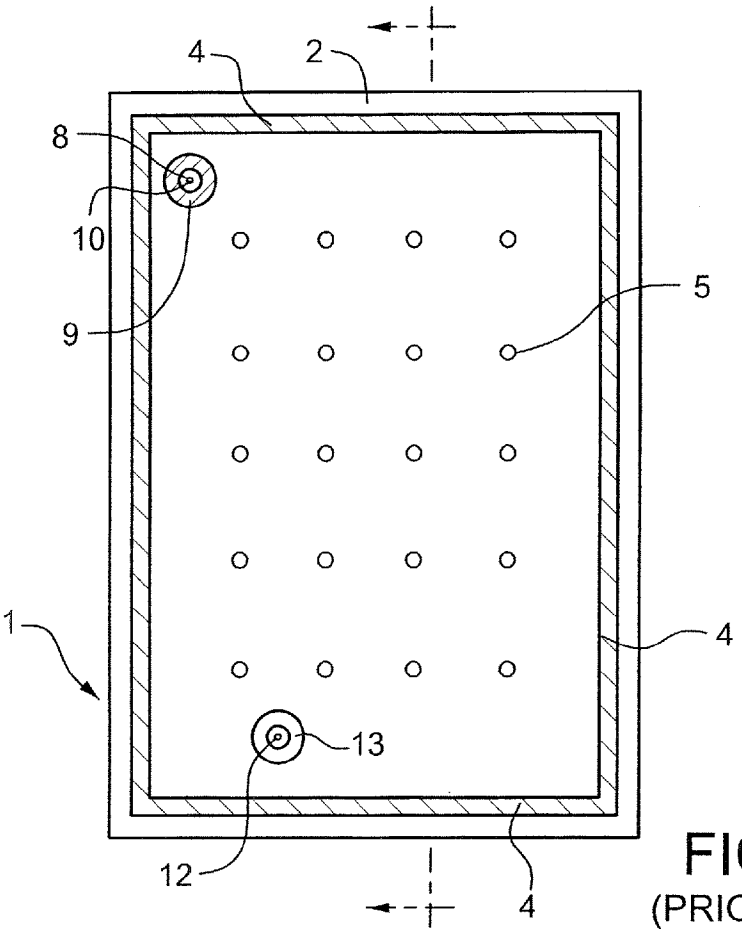
FIG. 2 (PRIOR ART)
FIG. 2 is a top plan view of the conventional VIG unit of FIG. 1.
Figure 1:
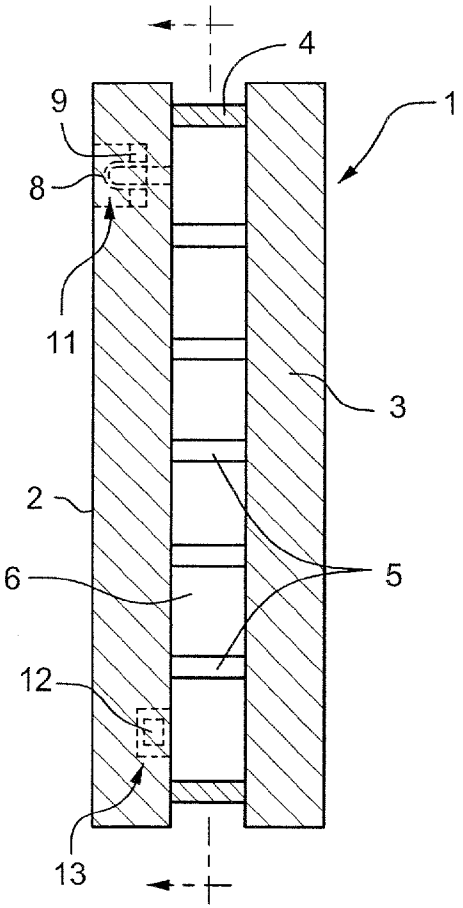
FIG. 1 (PRIOR ART)
FIG. 1 is a cross sectional schematic diagram of a conventional VIG unit.

Certain example embodiments will be described in detail herein with reference to the foregoing drawings in which like reference numerals refer to like elements throughout the several views. It will be understood that the embodiments described herein are intended to be illustrative, not limiting, and that those skilled in the art will understand that various modifications may be made without departing from the true spirit and full scope of the claims appended hereto.

Figure 3:
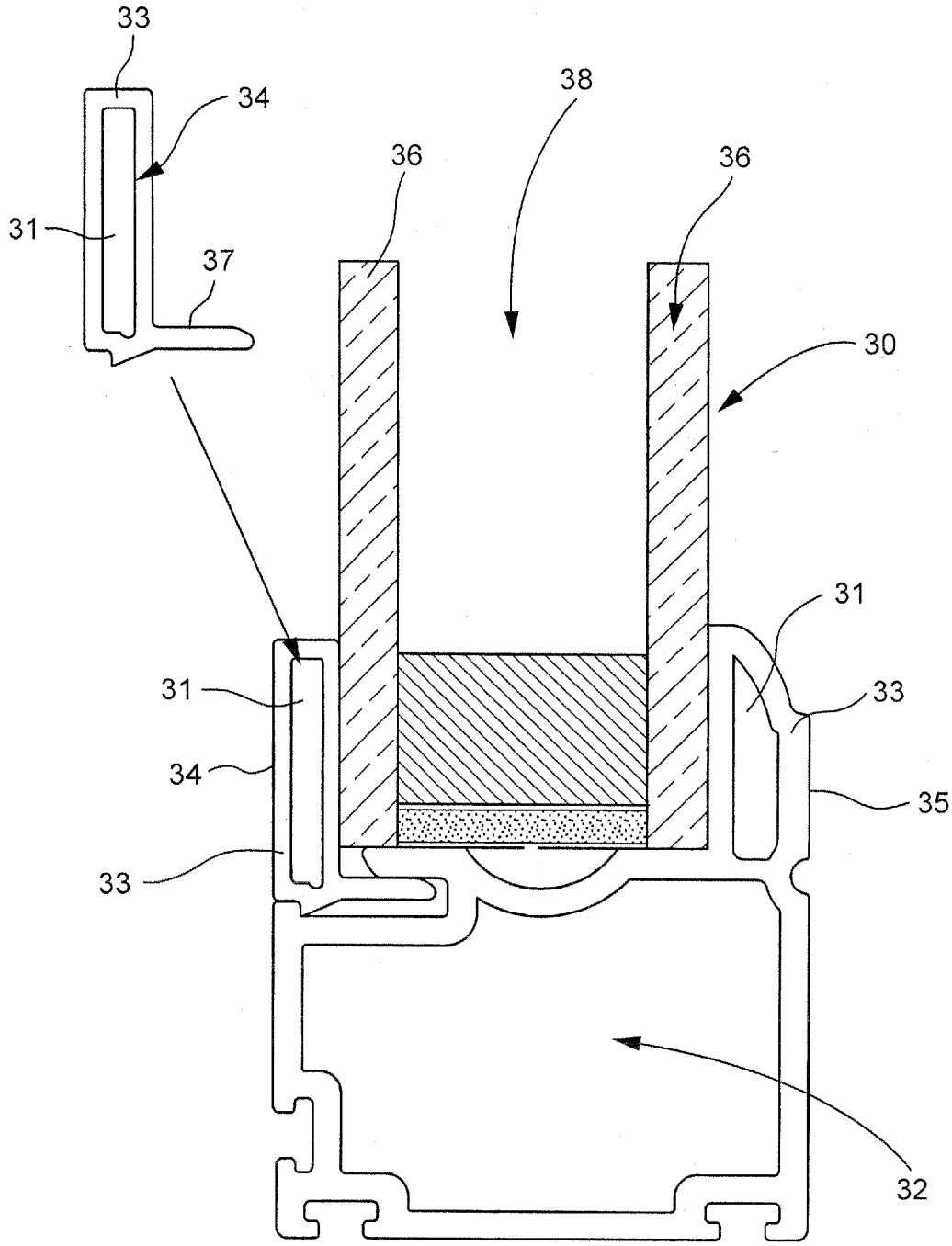
FIG. 3 is a schematic partial cross sectional diagram illustrating an example window frame designed for a standard IG window unit, with an IG window unit being located in the frame.
Figure 4:
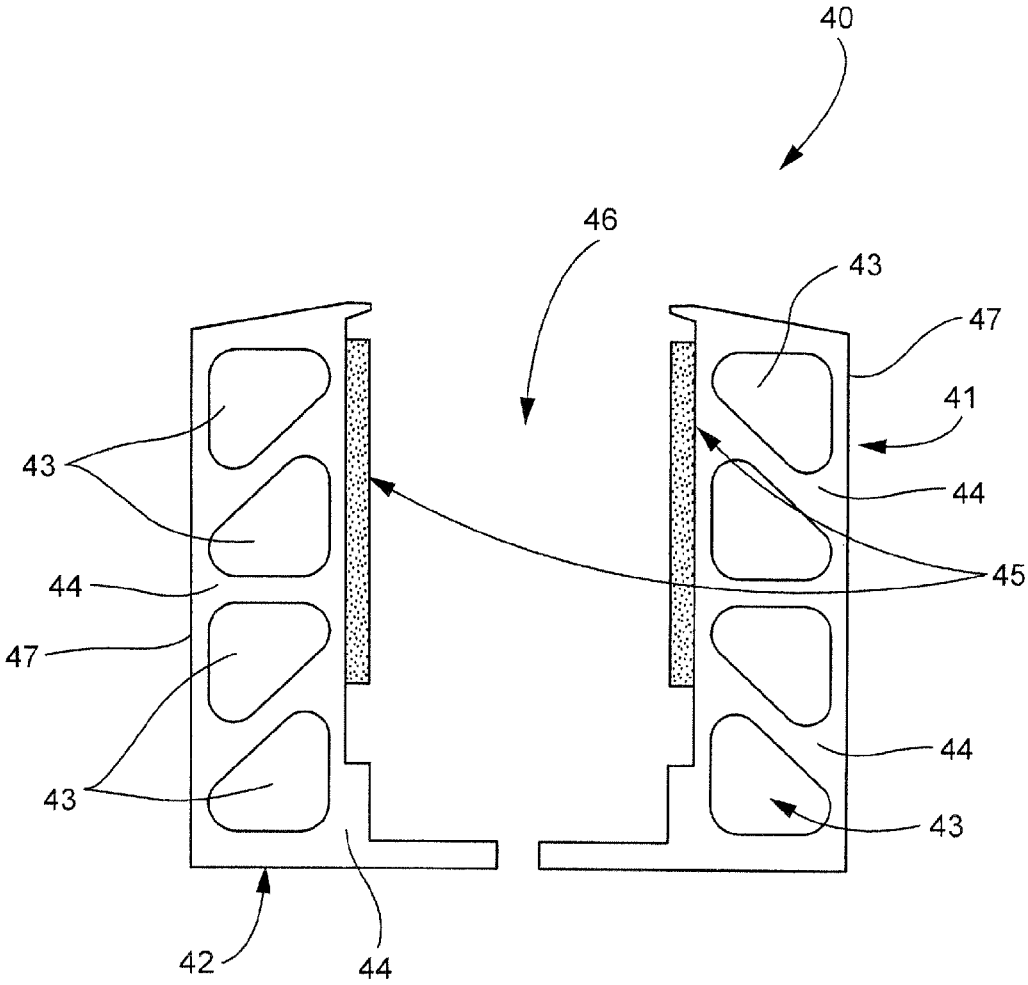
FIG. 4 is a schematic partial cross sectional diagram illustrating a spacer system for a VIG unit according to an example embodiment of this invention, the spacer system for allowing a VIG window unit to be installed in a window frame designed to accommodate at least a thicker IG window unit.

With reference to FIG. 3, a schematic partial cross sectional diagram illustrating a window frame (e.g., including a sash profile) designed for accommodating at least a standard and/or thick IG window unit 30. VIG units, and spacer systems therefore, according to example embodiments of this invention are adapted to be located in the window frame shown in FIG. 3 and/or in any other suitable window frame that is/was designed to accommodate at least IG window units. Thus, in certain example embodiments of this invention, the spacer system(s) and VIG unit(s) 1 shown in FIGS. 4-10 fit into and are housed in the window frame shown in FIG. 3, or in any other suitable window frame designed to accommodate IG window units. Of course, referring to FIG. 3, IG unit 30 is not present when the VIG unit 1 and spacer system therefore are mounted in the frame.

FIG. 3 illustrates IG unit 30, which may, for example and without limitation, include two panes of glass 36 defining an air or gas-filled gap 38 therebetween. The IG window unit 30 is shown seated in/on a window sash 32. The gap 38 between the glass substrates 36 is typically air and/or gas filled, and is at approximately atmospheric pressure (unlike a VIG window unit). The window sash 32 may include a first stop portion 35 that is part of and integral with the main sash portion 32, a second possibly removable stop 34 that may include a clip or other extending portion 37 for connecting the second stop 34 to the sash portion 32. Stops 34 and 35 may or may not be integral with main sash portion 32 which is provided under and/or adjacent the outer edge of the window unit. Stops 34 and 35 may be substantially parallel to each other, e.g., as shown in FIG. 3, in certain example embodiments. The shapes of stops 34 and 35 in FIG. 3 are for purposes of example only, so that other shaped stops may instead be provided. For example, one or both stops 34, 35 may or may not have a hollow portion (e.g., filled with air or something else) 31 surrounded by a solid portion 33 (e.g., see FIG. 3). In other example embodiments, one or both stops 34, 35 may be a solid piece (e.g., of plastic, wood or metal) including or consisting essentially of a substantially planar or planar portion that projects in a direction parallel to the glass substrates of the window unit. The window unit is held and/or positioned, directly or indirectly, between the stops 34, 35.

Still referring to FIG. 3, the IG unit 30 is supported by the sash portion 32, and held in place by stops 34, 35 on either side thereof. A distance between the stops 34 and 35 preferably corresponds to the thickness of the IG unit 30. IG window units 30 are rather thick, and come in various thicknesses (e.g., from about 19-40 mm thick and possibly thicker if three glass substrates are used instead of the two illustrated in FIG. 3). When the IG unit 30 is seated in/on the sash portion 32 and is engaged with the first stop portion 35, the second stop 34 is connected to the sash 32, for example, via the clip or extended portion 37. The stops 34, 35 provide lateral support to the IG window unit 30. The sash 32 and stop portions 34, 35 may be made of any suitable material, including, for example, and without limitation, PVC, fiberglass, wood, rubber, aluminum, various composites, or the like. As noted above, the width of a typical IG unit 30 is in a range of about 20 mm or greater depending on the type of 10 window unit. Accordingly, the gap between the stops 34 and 35 of the frame may typically be in a similar range such as at least 19 mm, more preferably from 19-40 mm, and most preferably from 20-35 mm or 20-30 mm.

Figure 5:
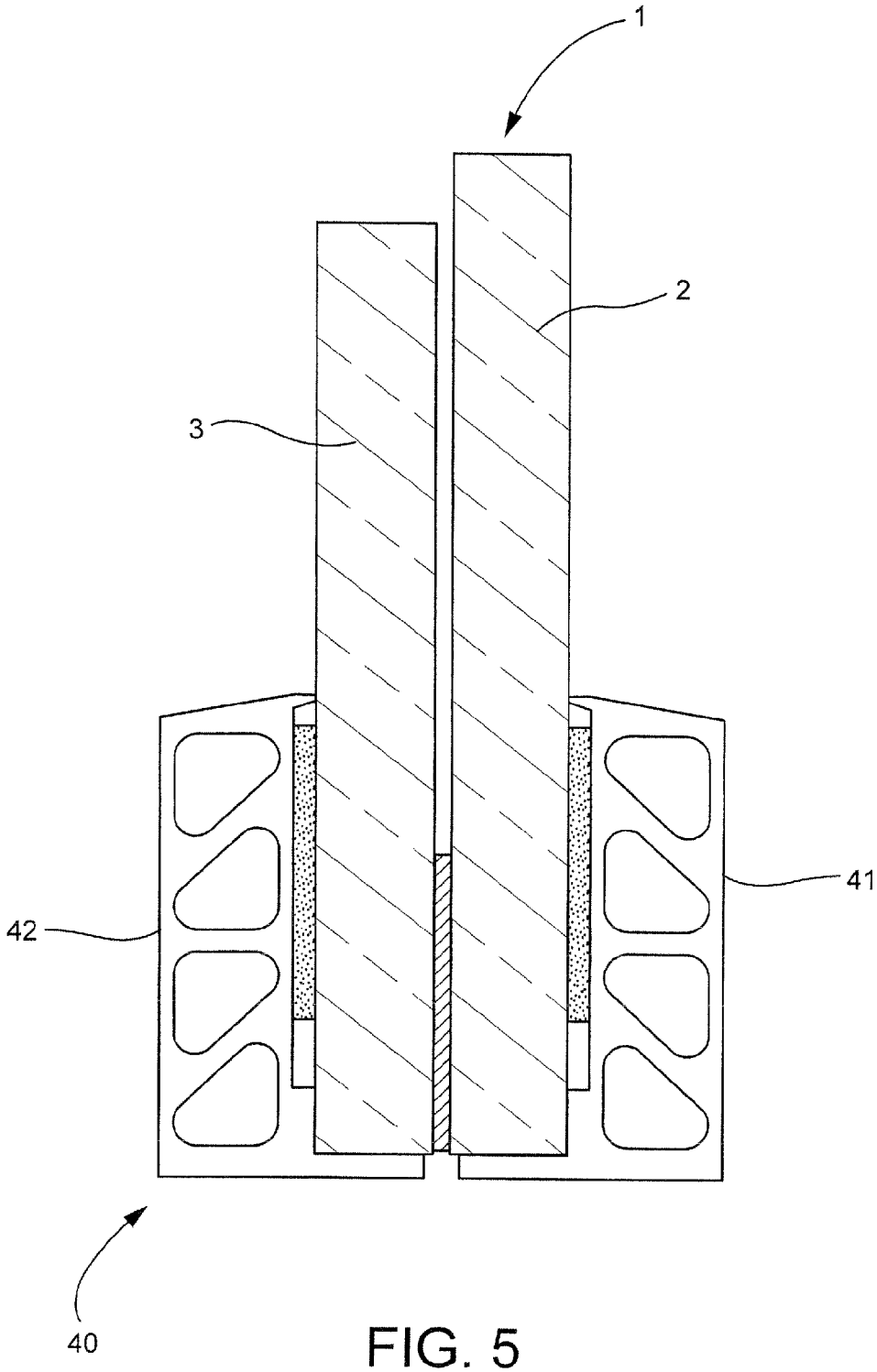
FIG. 5 is a schematic partial cross sectional diagram illustrating the spacer system of FIG. 4 around a VIG unit according to an example embodiment of this invention.
Figure 6:
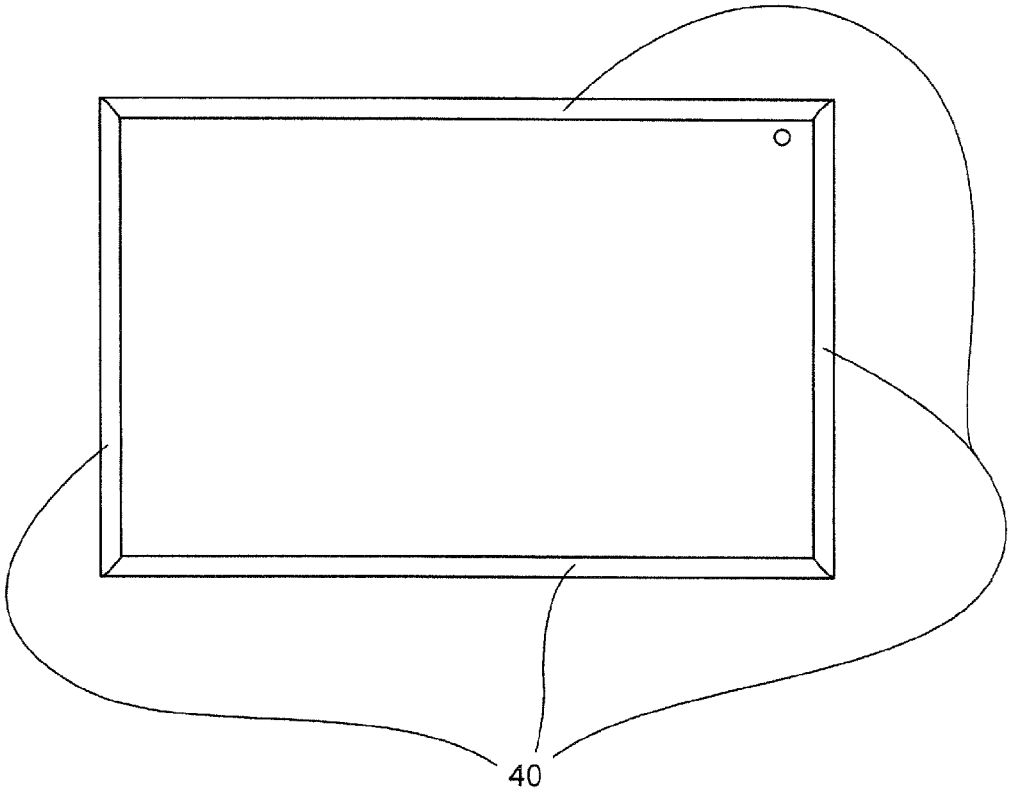
FIG. 6 is a side plan view of a window according to an example embodiment of this invention, illustrating that the spacer system of FIGS. 4-5 extends along all four sides of the window.
Figure 7:
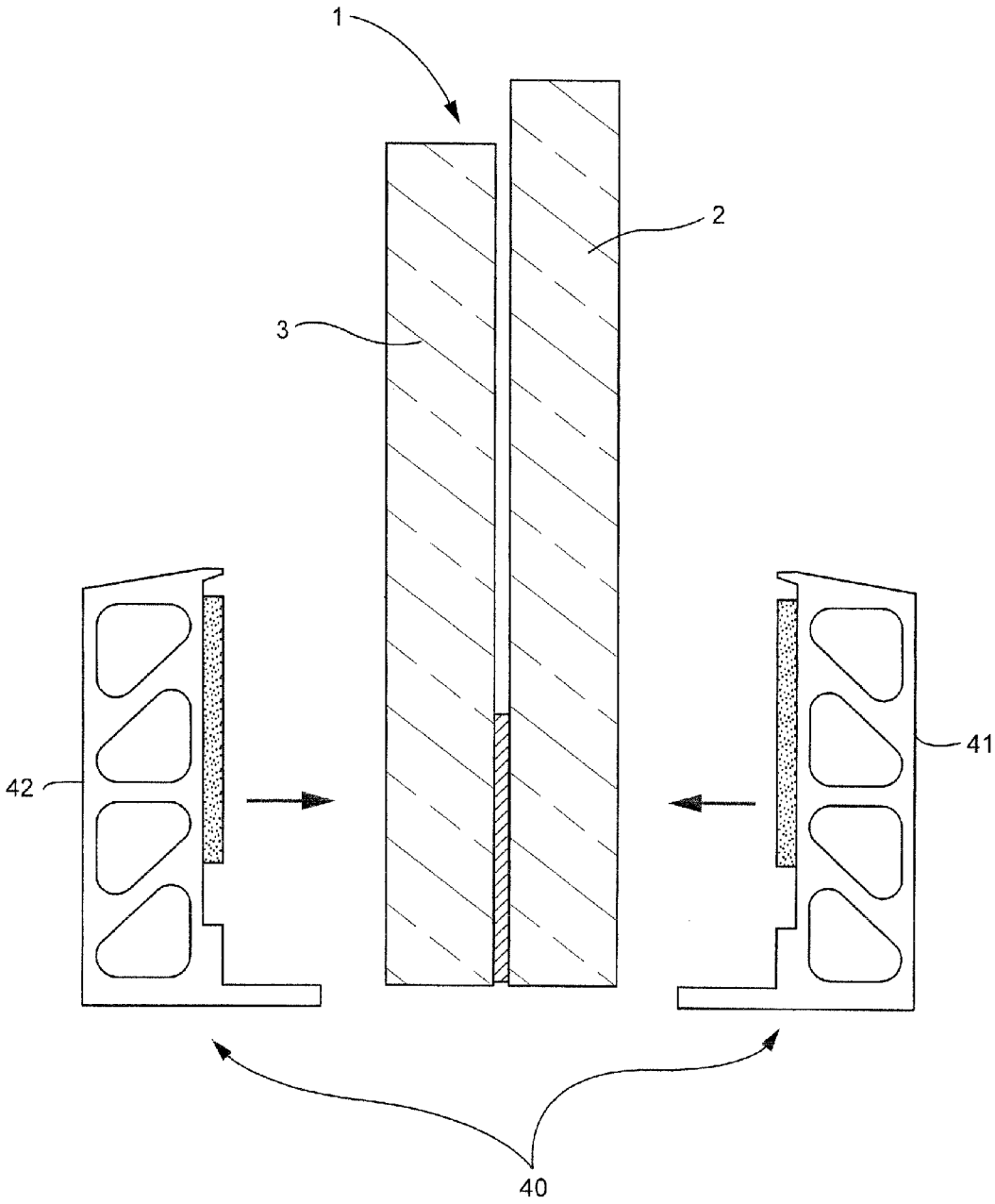
FIG. 7 is an exploded schematic cross sectional diagram illustrating the spacer system of FIGS. 4-6 being mounted around a VIG unit.
Figure 11:
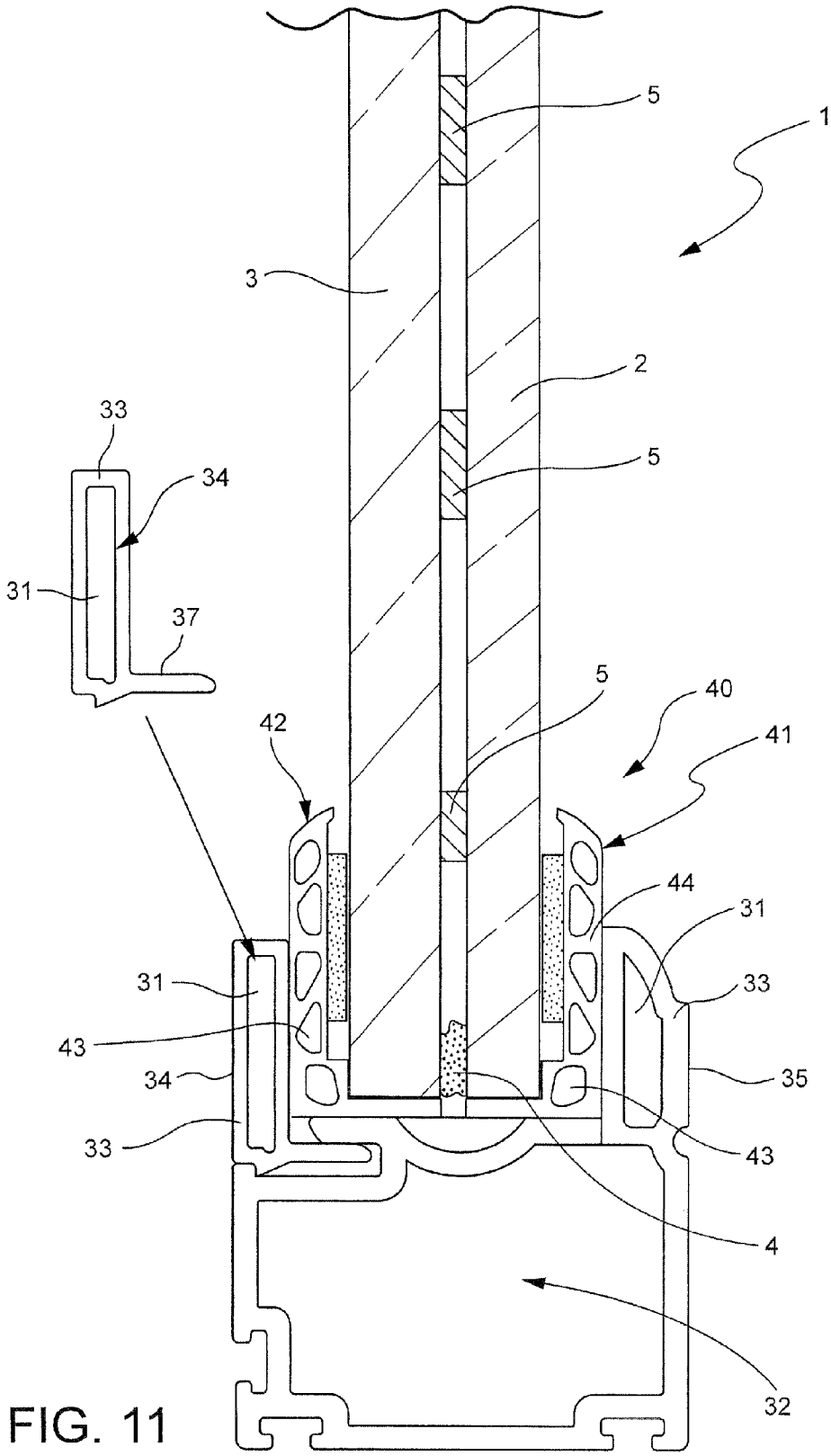
FIG. 11 is a schematic partial cross sectional diagram illustrating an the VIG unit and spacer structure of FIGS. 4-7 mounted in the window frame of FIG. 3 which was designed for a standard IG window unit.

FIGS. 4-7 are schematic partial cross sectional diagrams illustrating a spacer system/structure 40 for use in connection with a VIG window unit 1 according to an example embodiment of this invention, the spacer system/structure 40 for allowing the VIG window unit 1 to be installed in a window frame (e.g., in the window frame of FIG. 3, which frame does not include the IG window unit 30) designed to accommodate at least a thicker IG window unit 30 as shown in FIG. 11. The spacer structure 40 includes first and second portions 41, 42 that are attached to opposite sides, and the bottom, of the VIG window unit 1. Each of the portions 41, 42 may be substantially L-shaped as shown in FIGS. 4-7, or may be otherwise shaped. Each portion 41, 42 may be made of plastic (e.g., PVC) or any other suitable material, and includes a plurality of hollow areas 43 each of which is surrounded by a solid portion 44 as viewed cross sectionally as in FIGS. 4-7, to improve thermal resistance of the resulting window unit structure. In certain example embodiments, each of the portions 41, 42 of the spacer structure may be made of extruded vinyl (e.g., single extruded vinyl strips). Hollow areas 43 may be air passages/channels in certain example instances, which may or may not be open at ends thereof. In certain preferred embodiments, while the hollow areas 43 are surrounded by solid portions 44 when viewed cross sectionally, the hollow areas 43 are open at ends thereof (i.e., the hollow areas 43 are open at each of the four corners of the window unit, and are at atmospheric pressure). The spacer structure 40 is preferably provided around all four sides of the window unit (e.g., sec FIG. 6), and may be provided in four corresponding strips (one strip for each side of the window) which strips are each mitered at about a forty-five degree angle at each end. Thus, the mitered ends of respective strips of the spacer structure 40 are mated to each other at respective corners of the window unit. Adhesive strips (e.g., VIM strips) 45 may be provided on the interior sides of portions 41, 42 for attaching the spacer structure 40 to the VIG unit 1. The VIG unit 1 fits in the channel 46 defined between the portions 41, 42. For example, FIG. 5 shows the VIG window unit 1 mounted in channel 46 between the opposing portions 41, 42 of the spacer structure, and the arrows in FIG. 7 show how the portions 41, 42 are mounted to the VIG window unit 1 on opposing sides thereof.

The structure shown in FIGS. 4-7, including VIG window unit 1 and the spacer structure 40, is provided in a window frame, such as the window frame shown in FIG. 3, instead of IG window unit 30. In this respect, FIG. 11 illustrates the VIG window unit 1 and spacer structure 40 of FIGS. 4-7 mounted in the window frame of FIG. 3 which was designed for a standard IG window unit. Thus, the structure shown in FIGS. 4-7 may be used to replace an IG window unit 30 in the frame of FIG. 3, or alternatively the structure shown in FIGS. 4-7 may be originally provided in a window frame such as the example frame shown in FIG. 3 instead of an IG window unit 30 (e.g., see FIG. 11 in both respects). In particular, the structure shown in FIGS. 4-7, including VIG window unit 1 and the spacer structure 40, is provided in the window frame of FIG. 3 on the sash portion 32 and between the stops 34 and 35 as shown in FIG. 11. In other words, referring to at least FIG. 11, in FIG. 3 the IG window unit 30 is replaced with the VIG window unit 1 and spacer structure 40, with the exterior sidewalls 47 of the spacer portions 42 and 41 contacting or being adhered to the interior surfaces of stops 34 and 35 respectively (the same as how the exterior walls of the IG unit 30 contact or are adhered to the interior surfaces of stops 34, 35 in FIG. 3). Because the VIG window unit 1 is much thinner than the IG window unit 30, the thickness of the spacer structure 40 shown in FIGS. 4-7 allows the VIG window unit 1 to be installed in a window frame (e.g., the frame of FIG. 3) that was designed to accommodate at least a thicker IG window unit(s) 30.

Figure 8:
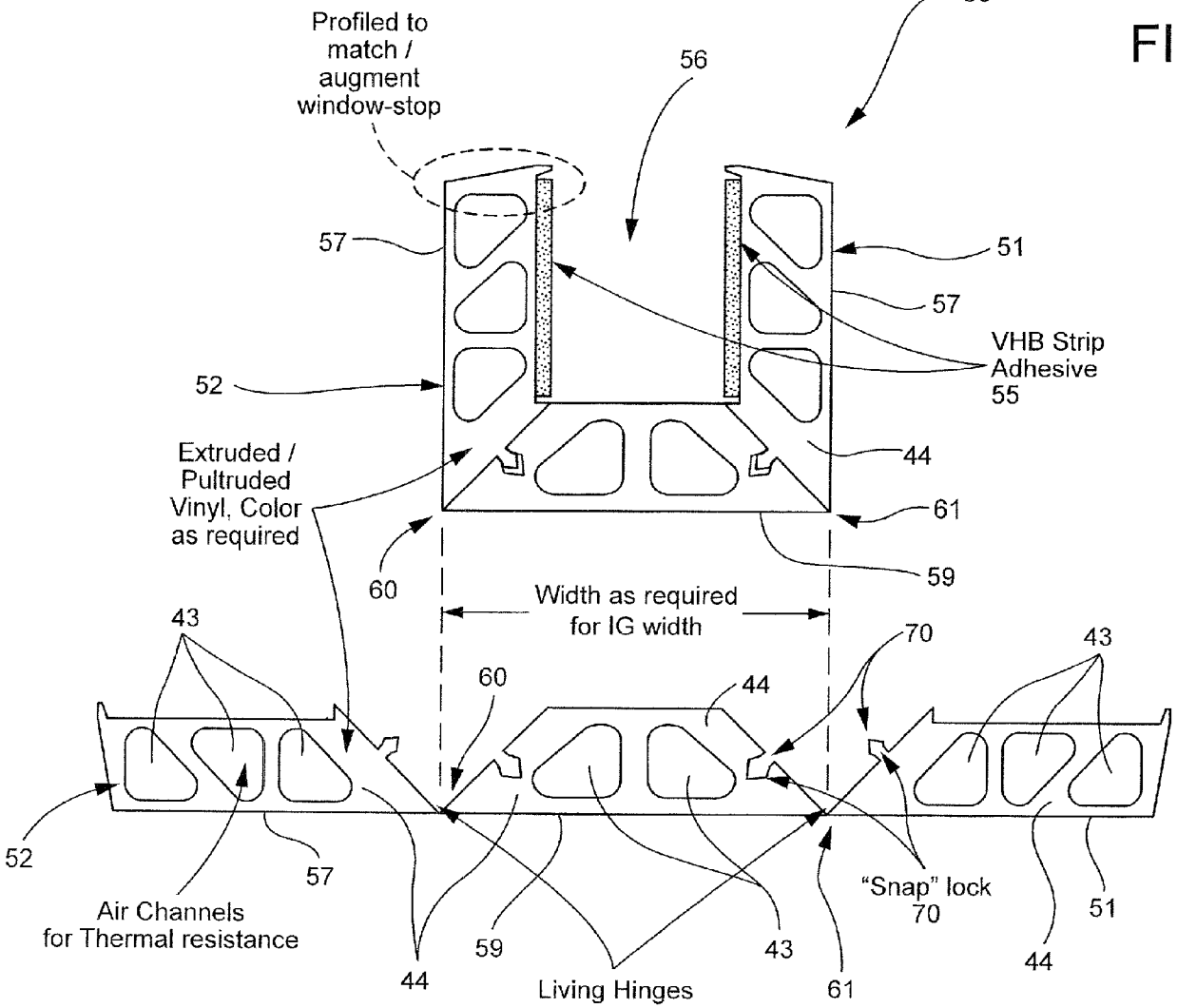
FIG. 8 is a schematic partial cross sectional diagram illustrating a spacer system for a VIG unit according to another example embodiment of this invention, the spacer system for allowing a VIG window unit to be installed in a window frame designed to accommodate at least a thicker IG window unit.
Figure 9:
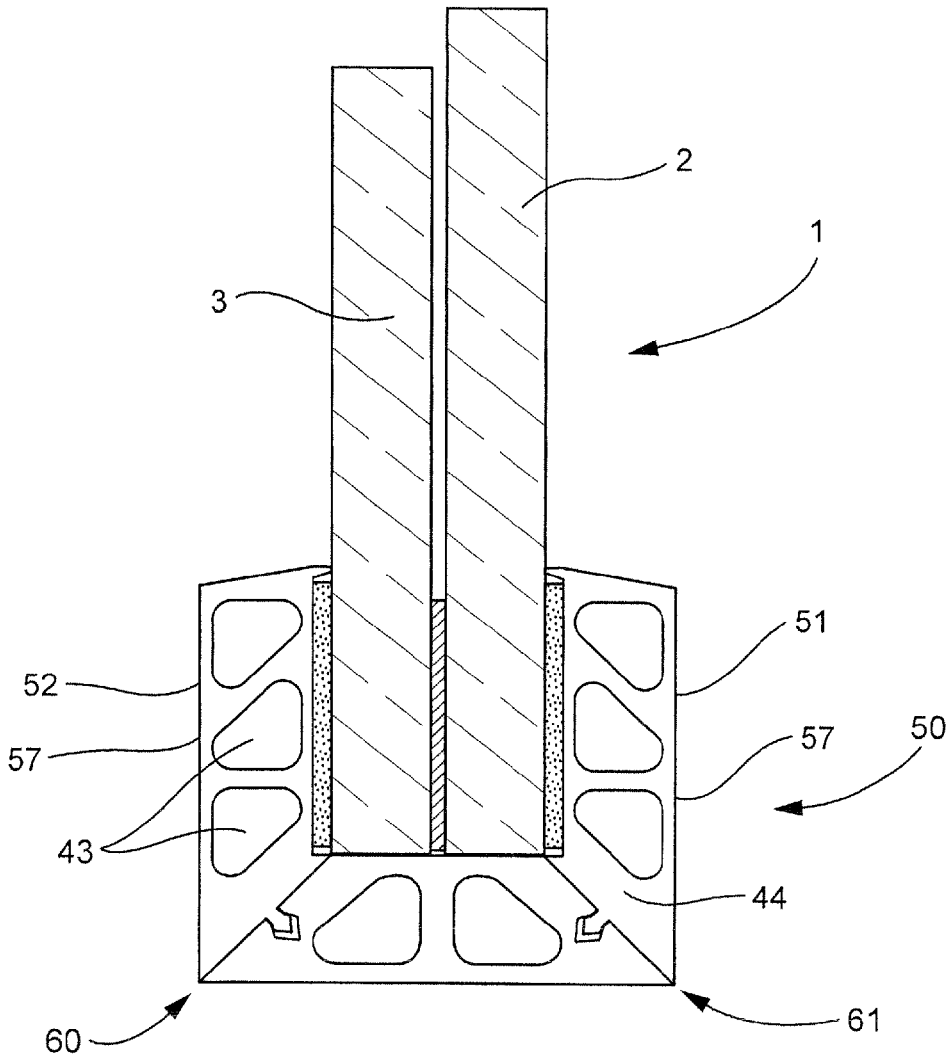
FIG. 9 is a schematic partial cross sectional diagram illustrating the spacer system of FIG. 8 around a VIG unit according to an example embodiment of this invention.
Figure 10:
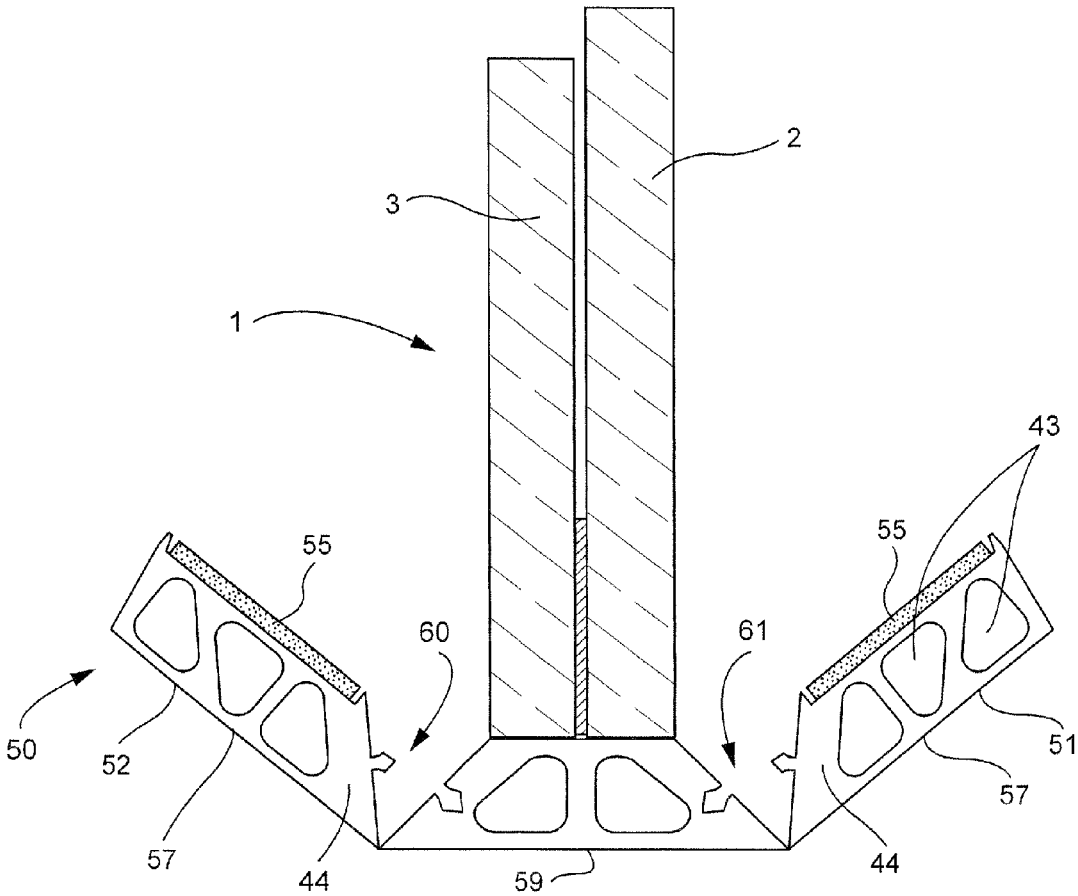
FIG. 10 is an exploded schematic cross sectional diagram illustrating the spacer system of FIGS. 8-9 being mounted around a VIG unit.

FIGS. 8-10 are schematic partial cross sectional diagrams illustrating a spacer system/structure 50 for use in connection with a VIG window unit 1 according to another example embodiment of this invention. The spacer system/structure 50 is for allowing the VIG window unit 1 to be installed in a window frame (e.g., the window frame of FIG. 3, which frame does not include the IG window unit 30) designed to accommodate at least a thicker IG window unit 30 (the same way that the FIG. 4-7 structure is mounted in the FIG. 3 window frame as shown in FIG. 11). The spacer structure 50 includes first and second portions 51 and 52 that are attached to opposite sides of the VIG window unit 1. Portions 51 and 52 are interconnected by base portion 59. Portions 51, 52 and 59 of the spacer structure 50 may lie flat during storage as shown at the bottom of FIG. 8, and the portions 51, 52 may then be folded upwardly relative to portion 59 in mounting the spacer structure 50 to the VIG window unit 1 as shown in the top portion of FIG. 8 and in FIGS. 9-10. Portions 51, 52, 59 may be made of plastic (e.g., PVC) or any other suitable material, and each may include a plurality of hollow areas 43 each of which is surrounded by a solid portion 44 as viewed cross sectionally as in FIGS. 8-10, to improve thermal resistance of the window unit. In certain preferred embodiments, while the hollow areas 43 are surrounded by solid portions 44 when viewed cross sectionally, the hollow areas 43 are open at ends thereof (i.e., the hollow areas 43 are open at each of the four corners of the window unit, and are at atmospheric pressure). In certain example embodiments, portions 51, 52, 59 of the spacer structure may be made of an extruded vinyl strip. Hollow areas 43 may be air passages/channels in certain example instances, which may or may not be open at ends thereof. The spacer structure 50 is preferably provided around all four sides of the window unit (e.g., as shown in FIG. 6), and may be provided in four corresponding strips (one strip for each side of the window) which are mitered at about a forty-five degree angle at each end as explained above in connection with FIGS. 4-7. Adhesive strips (e.g., VHB strips) 55 may be provided on the interior sides of portions 51, 52 for attaching the spacer structure 50 to the VIG unit 1. The VIG unit 1 fits in the channel 56 defined between the portions 51, 52. For example, FIG. 9 shows the VIG window unit 1 mounted in channel 56 between the opposing portions 51, 52 of the spacer structure, and FIG. 10 shows how the portions 51, 52 are folded relative to base portion 59 via living hinges 60, 61 in mounting the portions 51, 52 to the VIG window unit 1 on opposing sides thereof. The structure shown in FIGS. 8-10, including VIG window unit 1 and the spacer structure 50, is provided in a window frame, such as the window frame shown in FIG. 3, instead of IG window unit 30. The structure shown in FIGS. 8-10 may be used to replace an IG window unit 30 in the frame of FIG. 3, or alternatively the structure shown in FIGS. 8-10 may be originally provided in a window frame such as the example frame shown in FIG. 3 instead of an IG window unit 30. In particular, the structure shown in FIGS. 8-10, including VIG window unit 1 and the spacer structure 50, is provided in the window frame of FIG. 3 on the sash portion 32 and between the stops 34 and 35. In other words, in FIG. 3 the IG window unit 30 is replaced with the VIG window unit 1 and spacer structure 50, with the exterior sidewalls 57 of the spacer portions 52 and 51 contacting or being adhered to (directly or indirectly) the interior surfaces of stops 34 and 35 respectively (the same as how the exterior walls of the IG unit 30 contact or are adhered to the interior surfaces of stops 34, 35 in FIG. 3). Because the VIG window unit 1 is much thinner than the IG window unit 30, the thickness of the spacer structure 50 shown in FIGS. 8-10 allows the VIG window unit 1 to be installed in a window frame (e.g., the frame of FIG. 3) that was designed to accommodate at least a thicker IG window unit(s) 30.

Accordingly, referring to FIGS. 3-11, there is provided a method of installing a VIG window unit 1 in a window frame that was designed to house a larger IG window unit 30, the method including seating a VIG window unit 1, having a thickness of from about 4-12 mm (more preferably from about 4-10 mm thick, more preferably from about 7-9 mm thick, with an example thickness being about 8.3 mm) in a window frame (e.g., in the frame of FIG. 3), where the window frame is capable of supporting a thick IG window unit 30 having a larger thickness than does the VIG window unit 1. The VIG window unit 1 includes first and second glass substrates 2, 3 with a low pressure gap 6 provided therebetween, the low pressure gap 6 being at a pressure substantially less than atmospheric pressure. The VIG window unit 1 also includes a plurality of spacers (e.g., pillars) 5 located in the low pressure gap 6 between the first and second glass substrates 2, 3, and an edge seal 4 provided between the first and second glass substrates 2, 3 for hermetically sealing a periphery of the VIG unit 1 to substantially maintain the low pressure gap 6 at pressure less than atmospheric pressure.

When the VIG window unit is seated in the frame, the VIG unit 1 is supported on a first side by a first stop portion 35 (or 34) of said frame and is supported on a second side by a second stop portion 34 (or 35) of said frame. A gap between the stop portions 34 and 35 is from about 19-40 mm (more preferably from 19-40 mm, and most preferably from 20-35 mm or 20-30 mm). A spacer structure (40 or 50) is provided along at least one side of the VIG window unit 1 between the VIG window unit 1 and at least one of the first and second stop portions 35, 34 of the window frame, the spacer structure including at least one hollow area 43 surrounded by a solid portion 44 when viewed cross sectionally, wherein the hollow area(s) 43 is substantially filled with air, foam, and/or insulating material such as gas (e.g., argon). The spacer structure (40, 50) may be provided along all four sides of the VIG window unit (e.g., see FIG. 6), e.g., in four strips with angled ends which mate with each other at corners of the window unit. As shown in FIGS. 4-11, the spacer structure may include a plurality of hollow areas 43, each of the hollow areas being surrounded by a solid portion 44 and substantially filled with air and/or foam. The first and second stop portions 35, 34 may be substantially parallel or parallel to each other in certain example embodiments, and one or both of the stop portions may include a hollow space 31 surrounded, as viewed cross sectionally, by a solid portion 33 in certain example embodiments. Hollow space(s) 31 of the stop(s) may be filled or substantially filled with air and/or foam. The spacer structure (40, 50) may be provided along each of four sides of the VIG window unit and may be located (i) between the VIG window unit 1 and the first stop portion 35 (or 34), and (ii) between the VIG window unit 1 and the second stop portion 34 (or 35).

In certain example embodiments (e.g., see FIGS. 8-10), the spacer structure may comprise a base portion 59 interconnected between first and second substantially parallel extending portions 51, 52, with each of the first and second extending portions 51, 52 extending from the base portion 59 in a direction substantially parallel to glass substrates 2, 3 of the VIG window unit 1 when the VIG unit is mounted in the frame. And the first and second glass substrates 2, 3 of the VIG window unit 1 are located at least partially between the first and second extending portions 51, 52. A first living hinge 61 may be provided between the base portion 59 and the first extending portion 51, and a second living hinge 61 may be provided between the base portion 59 and the second extending portion 52, to allow the extending portions to bend about the living hinges in order to more easily attach the spacer structure to the periphery of the VIG unit 1. A first snap-lock structure 70 may be provided between (and possibly as part of) the base portion 59 and the first extending portion 51 for snap-connecting the first extending portion 51 to the base portion 59, and a second snap-lock structure 70 may be provided between (and possibly as part of) the base portion 59 and the second extending portion 52 for snap-connecting the second extending portion 52 to the base portion 59 (e.g., see the male and female portions of the snap-lock structures 70 in FIG. 8, that are used to snap together the extending portions to the base 59 after the extending portions 51, 52 have been bent about respective living hinges 61 into upright positions). Each of the first and second extending portions 51, 52 may comprise a plurality of hollow areas 43 each being surrounded by a solid portion 44, wherein the hollow areas are substantially filled with air, foam, and/or other insulating material. Adhesive 55 may be provided between the VIG window unit and the spacer structure, for attaching the spacer structure to the VIG window unit 1.

Certain example embodiments of this invention may or may not be used in connection with a re-profiled replacement window stop(s), e.g., for a window unit that takes up the difference in thickness between a multi pane non-vacuum insulated glass window unit and a VIG window unit with little modification to existing window designs, including the window sash. For example, this invention may or may not be used in connection with re-profiled replacement window stop(s) as described in Ser. No. 13/541,840, filed Jul. 5, 2012, which is incorporated herein by reference.

In certain embodiments of this invention, there is provided a method of installing a vacuum insulated glass (VIG) window unit, the method comprising: seating a VIG window unit, having a thickness of from about 4-12 mm, in a window frame, the window frame capable of supporting a non-vacuum 10 window unit having a larger thickness than does the VIG window unit, said VIG window unit comprising first and second glass substrates with a low pressure gap provided therebetween, the low pressure gap being at a pressure less than atmospheric pressure, and after said seating the VIG window unit being supported (directly or indirectly) on a first side by a first stop portion of said frame and being supported (directly or indirectly) on a second side by a second stop portion of said frame, and wherein a gap between the first and second stop portions is from about 19-40 mm; and wherein a spacer structure is provided along at least one side of the VIG window unit between the VIG window unit and at least one of the first and second stop portions of the window frame, the spacer structure including at least one hollow area surrounded by a solid portion when viewed cross sectionally, wherein the hollow area is substantially filled with air, foam, and/or insulating material.

In the method of the immediately preceding paragraph, the spacer structure may be provided along all four sides of the VIG window unit.

In the method of any of the preceding two paragraphs, the hollow area of the spacer structure may be filled or substantially filled with foam.

In the method of any of the preceding three paragraphs, the hollow area of the spacer structure may comprise a void filled or substantially filled with air.

In the method of any of the preceding four paragraphs, the spacer structure may include a plurality of hollow areas, each of the hollow areas being surrounded by a solid portion and substantially filled with air and/or foam.

In the method of any of the preceding five paragraphs, the first and second stop portions may be substantially parallel or parallel to each other.

In the method of any of the preceding six paragraphs, at least one of the first and second stop portions may include a hollow space surrounded, as viewed cross sectionally, by a solid portion.

In the method of any of the preceding seven paragraphs, the hollow space(s) of the stop(s) may be filled or substantially filled with air and/or foam.

In the method of any of the preceding eight paragraphs, each of the first and second stop portions may comprise at least one hollow space surrounded, as viewed cross sectionally, by a solid portion.

In the method of any of the preceding nine paragraphs, the spacer structure may be provided along each of four sides of the VIG window unit and may be located (i) between the VIG window unit and the first stop portion, and (ii) between the VIG window unit and the second stop portion.

In the method of any of the preceding ten paragraphs, the VIG window unit may comprise a plurality of spacers located in the low pressure gap between the first and second glass substrates.

In the method of any of the preceding eleven paragraphs, the VIG window unit may comprise an edge seal provided between the first and second glass substrates for hermetically sealing a periphery of the VIG unit to substantially maintain the low pressure gap at pressure less than atmospheric pressure.

In the method of any of the preceding twelve paragraphs, the spacer structure may comprise a base portion interconnected between first and second substantially parallel extending portions, each of the first and second extending portions extending from the base portion in a direction substantially parallel to glass substrates of the VIG window unit, and wherein the first and second glass substrates of the VIG window unit are located at least partially between the first and second extending portion. A first living hinge may be provided between the base portion and the first extending portion, and a second living hinge may be provided between the base portion and the second extending portion. The spacer structure may include a first snap-lock structure between the base portion and the first extending portion for snap-connecting the first extending portion to the base portion, and a second snap-lock structure between the base portion and the second extending portion for snap-connecting the second extending portion to the base portion. Each of the first and second extending portions may comprise a plurality of hollow areas each being surrounded by a solid portion, wherein the hollow areas are substantially filled with air, foam, and/or other insulating material.

In the method of any of the preceding thirteen paragraphs, adhesive may be provided between the VIG window unit and the spacer structure.

The method of any of the preceding fourteen paragraphs may further comprise removing an existing stop from said window frame and replacing the existing stop with a VIG stop, said existing stop having supported a previously installed non-vacuum IG window unit with a larger width than a width of the VIG window unit. After removing the existing stop, the method may comprise removing the IG window unit and thereafter seating the VIG window unit and installing the VIG stop to replace the existing stop.

In the method of any of the preceding fifteen paragraphs, the spacer structure is preferably not part of a window frame which was designed to house the non-vacuum IG window unit having a larger width than the VIG window unit.

In certain example embodiments of this invention, there is provided a window unit comprising: a VIG window unit in a window frame, the window frame capable of supporting a non-vacuum IG window unit having a larger thickness than does the VIG window unit, said VIG window unit comprising first and second glass substrates with a low pressure gap provided therebetween, the low pressure gap being at pressure less than atmospheric pressure; the VIG window unit being supported (directly or indirectly) on a first side by a first stop portion of said frame and being supported (directly or indirectly) on a second side by a second stop portion of said frame; and a spacer structure provided along at least one side of the VIG window unit between the VIG window unit and at least one of the first and second stop portions of the window frame, the spacer structure including at least one hollow area surrounded by a solid portion when viewed cross sectionally.

In the window unit of the immediately preceding paragraph, the hollow area may be substantially filled with air, foam, and/or insulating material such as gas (e.g., argon) or plastic.

In the window unit of any of the preceding two paragraphs, the spacer structure may be provided along all four sides of the VIG window unit.

In the window unit of any of the preceding three paragraphs, the hollow area of the spacer structure may be filled or substantially filled with air and/or foam.

In the window unit of any of the preceding four paragraphs, the spacer structure may include a plurality of hollow areas with each of the hollow areas being surrounded by a solid portion and substantially filled with air and/or foam.

In the window unit of any of the preceding five paragraphs, the first and second stop portions may extend in direction(s) substantially parallel to each other.

In the window unit of any of the preceding six paragraphs, at least one of the first and second stop portions may include a hollow space surrounded, as viewed cross sectionally, by a solid portion, the hollow space of the stop portion(s) being filled or substantially filled with air, foam, or other insulating material.

In the window unit of any of the preceding seven paragraphs, the spacer structure may be provided along each of four sides of the VIG window unit and may be located (i) between the VIG window unit and the first stop portion, and (ii) between the VIG window unit and the second stop portion.

In the window unit of any of the preceding eight paragraphs, the VIG window unit may comprise a plurality of spacers located in the low pressure gap between the first and second glass substrates, and an edge seal provided between the first and second glass substrates for hermetically sealing a periphery of the VIG unit to substantially maintain the low pressure gap at pressure less than atmospheric pressure.

In the window unit of any of the preceding nine paragraphs, the spacer structure may comprise a base portion interconnected between first and second substantially parallel extending portions, each of the first and second extending portions extending from the base portion in a direction substantially parallel to glass substrates of the VIG window unit, and wherein the first and second glass substrates of the VIG window unit are located at least partially between the first and second extending portions. The spacer structure may comprise a first living hinge between the base portion and the first extending portion, and a second living hinge between the base portion and the second extending portion. The spacer structure may comprise a first snap-lock structure between the base portion and the first extending portion for snap-connecting the first extending portion to the base portion, and a second snap-lock structure between the base portion and the second extending portion for snap-connecting the second extending portion to the base portion. Each of the first and second extending portions may comprise a plurality of hollow areas each being surrounded by a solid portion, wherein the hollow areas are substantially filled with air, foam, and/or other insulating material.

In the window unit of any of the preceding ten paragraphs, the spacer structure need not be part of the window frame.

In the window unit of any of the preceding eleven paragraphs, the VIG unit may have a thickness of from about 4-12 mm, and a gap between the first and second stop portions may be from about 19-40 mm thick.

While certain example embodiments have been described and disclosed herein, it will be understood that the embodiments described herein are intended to be illustrative, not limiting, and that hose skilled in the art will understand that various modifications may be made without departing from the true spirit and full scope of the claims appended hereto.

What is claimed is:

1. A method of installing a vacuum insulated glass (VIG) window unit, the method comprising:

seating a VIG window unit, having a thickness of from about 4-12 mm, in a window frame, the window frame capable of supporting a non-vacuum IG window unit having a larger thickness than the VIG window unit, the VIG window unit comprising first and second glass substrates with a low pressure gap provided therebetween, the low pressure gap being at pressure less than atmospheric pressure, the VIG window unit being supported on a first side by a first stop portion of said frame and being supported on a second side by a second stop portion of said frame, and wherein a gap between the first and second stop portions is from about 19-40 mm;

wherein a spacer structure is provided along at least one side of the VIG window unit between the VIG window unit and at least one of the first and second stop portions of the window frame, the spacer structure including at least one hollow area surrounded by a solid portion when viewed cross sectionally, wherein the hollow area is substantially filled with air, foam, and/or insulating material;

the spacer structure comprises a base portion interconnected between first and second substantially parallel extending portions each of the first and second extending portions extending from the base portion in a direction substantially parallel to glass substrates of the VIG window unit, and wherein the first and second glass substrates of the VIG window unit are located at least partially between the first and second extending portions; and wherein the spacer structure comprises a first living hinge between the base portion and the first extending portion, and a second living hinge between the base portion and the second extending portion.

2. The method of claim 1, wherein the spacer structure is provided along all four sides of the VIG window unit.

3. The method of claim 1, wherein the hollow area of the spacer structure is filled or substantially filled with foam.

4. The method of claim 1, wherein the hollow area of the spacer structure comprises a void filled or substantially filled with air.

5. The method of claim 1, wherein the spacer structure includes a plurality of hollow areas, each of the hollow areas being surrounded by a solid portion and substantially filled with air and/or foam.

6. The method of claim 1, wherein the first and second stop portions are substantially parallel to each other.

7. The method of claim 1, wherein at least one of the first and second stop portions includes a hollow space surrounded, as viewed cross sectionally, by a solid portion.

8. The method of claim 7, wherein the hollow space of the stop portion(s) is filled or substantially filled with air and/or foam.

9. The method of claim 1, wherein the spacer structure is provided along each of four sides of the VIG window unit and is located (i) between the VIG window unit and the first stop portion, and (ii) between the VIG window unit and the second stop portion.

10. The method of claim 1, wherein the VIG window unit comprises a plurality of spacers located in the low pressure gap between at least the first and second glass substrates.

11. The method of claim 1, wherein the VIG window unit comprises an edge seal provided between the first and second glass substrates for hermetically sealing a periphery of the VIG unit to substantially maintain the low pressure gap at pressure less than atmospheric pressure.

12. The method of claim 1, wherein adhesive is provided between the VIG window unit and the spacer structure.

13. The method of claim 1, wherein the spacer structure is not part of the window frame, the window frame having been designed to house the non-vacuum IG window unit having a larger width than the VIG window unit.

14. A method of installing a vacuum insulated glass (VIG) window unit, the method comprising:

seating a VIG window unit, having a thickness of from about 4-12 mm, in a window frame, the window frame capable of supporting a non-vacuum IG window unit having a larger thickness than the VIG window unit, the VIG window unit comprising first and second glass substrates with a low pressure gap provided therebetween, the low pressure gap being at pressure less than atmospheric pressure, the VIG window unit being supported on a first side by a first stop portion of said frame and being supported on a second side by a second stop portion of said frame, and wherein a gap between the first and second stop portions is from about 19-40 mm;

wherein a spacer structure is provided along at least one side of the VIG window unit between the VIG window unit and at least one of the first and second stop portions of the window frame, the spacer structure including at least one hollow area surrounded by a solid portion when viewed cross sectionally, wherein the hollow area is substantially filled with air, foam, and/or insulating material;

the spacer structure comprises a base portion interconnected between first and second substantially parallel extending portions, each of the first and second extending portions extending from the base portion in a direction substantially parallel to glass substrates of the VIG window unit, and wherein the first and second glass substrates of the VIG window unit are located at least partially between the first and second extending portions; and wherein the spacer structure comprises a first snap-lock structure for snap-connecting the first extending portion to the base portion, and a second snap-lock structure for snap-connecting the second extending portion to the base portion.

15. The method of claim 14, wherein each of the first and second extending portions comprises a plurality of hollow areas each being surrounded by a solid portion, wherein the hollow areas are substantially filled with air and/or foam.

16. The method of claim 14, wherein the spacer structure is not part of the window frame, the window frame having been designed to house the non-vacuum IG window unit having a larger width than the VIG window unit.

17. A window unit comprising:

a VIG window unit in a window frame, the window frame capable of supporting a non-vacuum IG window unit having a larger thickness than does the VIG window unit, said VIG window unit comprising first and second glass substrates with a low pressure gap provided therebetween, the low pressure gap being at pressure less than atmospheric pressure;

the VIG window unit being supported on a first side by a first stop portion of said frame and being supported on a second side by a second stop portion of said frame;

a spacer structure provided along at least one side of the VIG window unit between the VIG window unit and at least one of the first and second stop portions of the window frame, the spacer structure including at least one hollow area surrounded by a solid portion when viewed cross sectionally;

wherein the spacer structure comprises a base portion interconnected between first and second substantially parallel extending portions, each of the first and second extending portions extending from the base portion in a direction substantially parallel to glass substrates of the VIG window unit, and wherein the first and second glass substrates of the VIG window unit are located at least partially between the first and second extending portions; and wherein the spacer structure comprises a first snap-lock structure for snap-connecting the first extending portion to the base portion, and a second snap-lock structure for snap-connecting the second extending portion to the base portion.

18. The window unit of claim 17, wherein the hollow area is substantially filled with air and/or foam.

19. The window unit of claim 17, wherein the spacer structure is provided along all four sides of the VIG window unit.

20. The window unit of claim 17, wherein the spacer structure includes a plurality of hollow areas, each of the hollow areas being surrounded by a solid portion when viewed cross sectionally and substantially filled with air and/or foam.

21. The window unit of claim 17, wherein the first and second stop portions extend in direction(s) substantially parallel to each other.

22. The window unit of claim 17, wherein at least one of the first and second stop portions includes a hollow space surrounded, as viewed cross sectionally, by a solid portion, the hollow space of the stop portion(s) being filled or substantially filled with air and/or foam.

23. The window unit of claim 17, wherein the spacer structure is provided along each of four sides of the VIG window unit and is located (i) between the VIG window unit and the first stop portion, and (ii) between the VIG window unit and the second stop portion.

24. The window unit of claim 17, wherein the VIG window unit comprises a plurality of spacers located in the low pressure gap between the first and second glass substrates, and an edge seal provided between the first and second glass substrates for hermetically sealing a periphery of the VIG unit to substantially maintain the low pressure gap at pressure less than atmospheric pressure.

25. The window unit of claim 17, wherein the VIG unit has a thickness of from about 4-12 mm, and a gap between the first and second stop portions is from about 19-40 mm.

26. A window unit comprising:

VIG window unit in a window frame, the window frame capable of sup supporting a non-vacuum IG window unit having a larger thickness than does the VIG window unit, said VIG window unit comprising first and second glass substrates with a low pressure gap provided therebetween, the low pressure gap being at pressure less than atmospheric pressure;

the VIG window unit being supported on a first side by a first stop portion of said frame and being supported on a second side by a second stop portion of said frame;

a spacer structure provided along at least one side of the VIG window unit between the VIG window unit and at least one of the first and second stop portions of the window frame, the spacer structure including at least one hollow area surrounded by a solid portion when viewed cross sectionally;

wherein the spacer structure comprises a base portion interconnected between first and second substantially parallel extending portions, each of the first and second extending portions extending from the base portion in a direction substantially parallel to glass substrates of the VIG window unit, and wherein the first and second glass substrates of the VIG window unit are located at least partially between the first and second extending portions; and wherein the spacer structure comprises a first living hinge between the base portion and the first extending portion, and a second living hinge between the base portion and the second extending portion.

27. The window unit of claim 26, wherein each of the first and second extending portions comprises a plurality of hollow areas each being surrounded by a solid portion, wherein the hollow areas are substantially filled with air and/or foam.

* * * * *